United States Patent [19]

Iwata et al.

[11] Patent Number: 4,739,741

[45] Date of Patent: Apr. 26, 1988

[54] FUEL SUPPLY CONTROL METHOD FOR INTERNAL COMBUSTION ENGINES AT STARTING

[75] Inventors: Takahiro Iwata; Hidehito Ikebe; Takeo Kiuchi, all of Wako, Japan

[73] Assignee: Honda Giken Kogyo K.K., Tokyo, Japan

[21] Appl. No.: 919,794

[22] Filed: Oct. 16, 1986

[30] Foreign Application Priority Data

Oct. 18, 1985 [JP] Japan ..... 60-232823

[51] Int. Cl.[4] ..... F02B 3/02

[52] U.S. Cl. ..... 123/491; 123/179 L

[58] Field of Search ..... 123/179 L, 179 G, 491

[56] References Cited

U.S. PATENT DOCUMENTS

| | | | |
|---|---|---|---|
| 4,193,380 | 3/1980 | Marchak | 123/491 |
| 4,239,022 | 12/1980 | Drews | 123/491 |
| 4,432,325 | 2/1984 | Auracher | 123/491 |
| 4,438,748 | 3/1984 | Ikeura | 123/491 |
| 4,444,173 | 4/1984 | Yamato | 123/491 |
| 4,478,194 | 10/1984 | Yamato | 123/491 |
| 4,492,206 | 1/1985 | Hasegawa | 123/491 |
| 4,582,036 | 4/1986 | Kiuchi | 123/491 |

FOREIGN PATENT DOCUMENTS

| | | | |
|---|---|---|---|
| 2025087 | 1/1980 | United Kingdom | 123/491 |
| 2146800 | 4/1985 | United Kingdom | 123/491 |

*Primary Examiner*—Ronald B. Cox

*Attorney, Agent, or Firm*—Arthur L. Lessler

[57] ABSTRACT

A method of controlling fuel supply to an internal combustion engine at the start thereof. A fuel quantity to be supplied to said engine is set in dependence on a temperature of the engine when the engine is in a predetermined starting condition, and the fuel quantity thus set is corrected to an increased value by means of a correction value which varies with a rise in the rotational speed of the engine. The varying rate of the correction value is set in dependence on the engine temperature such that the set fuel quantity decreases at a first rate with a rise in the engine rotational speed when the engine temperature is higher than a predetermined value, and at a second rate smaller than the first rate with a rise in the engine rotational speed when the engine temperature is lower than the predetermined value. The set fuel quantity is corrected by means of the correction value having its varying rate set as above while the engine is in the predetermined starting condition.

6 Claims, 3 Drawing Sheets

FUEL SUPPLY CONTROL METHOD FOR INTERNAL COMBUSTION ENGINES AT STARTING

BACKGROUND OF THE INVENTION

This invention relates to a fuel supply control method for internal combustion engines at the start thereof, and more particularly to a method of this kind which supplies the engine with a required amount of fuel commensurate with the temperature of the engine to thereby enhance the startability of the engine.

In an internal combustion engine equipped with fuel injection valves, fuel injected into an intake pipe by each of the fuel injection valves is carried by intake air flowing in the intake pipe and drawn together with the intake air into a corresponding cylinder via a corresponding intake valve. At the start of the engine, part of the fuel injected into the intake pipe adheres to wall surfaces of the intake pipe in the vicinity of the intake valve, and gradually evaporates with the lapse of time to be supplied into the cylinder with delay in such a manner that part of the fuel adhering to the intake pipe wall surfaces evaporates to be drawn into the cylinder during a suction stroke of the engine in the cycle in which the fuel is injected, and the remaining fuel evaporates to be drawn into the cylinder during a suction stroke in the next cycle or during a suction stroke in the cycle subsequent to the next cycle. The lower the temperature of the intake pipe the higher percent of fuel adheres to the intake pipe wall surfaces and the longer time the injected fuel takes to evaporate. On the other hand, when the engine temperature is raised as the engine is subjected to several times of combustion or when the engine rotational speed increases so that vacuum is developed in the intake pipe, the percentage of fuel adhering to the intake pipe wall surfaces becomes lower.

It has been empirically recognized that the amount of adhesion of fuel to the intake pipe wall surfaces, i.e., the evaporation characteristic of fuel on the intake pipe wall surfaces largely depends upon whether or not the intake pipe temperature is higher than a certain critical value (approximately 9° C.). To be specific, we have conducted experiments to find the following fact: Provided that the required amount of injected fuel per each cylinder at cranking engine rpm of 150 rpm is 100 when the intake pipe temperature is higher than the above critical value (after the engine has been warmed up), the same required amount is 30 when the engine has reached a completely fired state (at 600 rpm) after the engine rotational speed has been increased by initial firing. On the other hand, when the intake pipe temperature is lower than the critical value (i.e., when the engine is in a cold state), the fuel adhering to the intake pipe wall surfaces takes long to evaporate due to the low intake pipe temperature, and accordingly the required amount of injected fuel per each cylinder has to be 50 even when the engine has reached a completely fired state (at 600 rpm), while the same required amount is 100 at the cranking engine rpm of 150.

In view of the above described evaporation characteristic of the injected fuel, it has conventionally been proposed, e.g., by Japanese Provisional Patent Publication (Kokai) No. 57-206736, to determine a value of the fuel injection period for fuel injection valves in dependence on the engine temperature, that conforms to the above described evaporation characteristic of the injected fuel, and correct the determined fuel injection period value by means of a correction coefficient which decreases at a fixed rate with a rise in the engine rotational speed.

According to this proposed method, however, since the correction coefficient decreases at a fixed rate with a rise in the engine rotational speed, it is difficult to smoothly attain complete firing of the engine when the engine is started in a cold state, often resulting in failure of smooth starting of the engine.

SUMMARY OF THE INVENTION

It is the object of the invention to provide a fuel supply control method for an internal combustion engine at the start thereof, which is capable of effecting fuel supply to the engine in response to the engine temperature at the start of the engine to thereby enhance the startability of the engine.

The present invention provides a method of controlling fuel supply to an internal combustion engine at the start thereof, wherein a fuel quantity to be supplied to the engine is set in dependence on a temperature of the engine when the engine is in a predetermined starting condition, and the fuel quantity thus set is corrected to an increased value by means of a correction value which varies with a rise in the rotational speed of the engine.

The method is characterized by comprising the following steps:

(1) determining whether or not the temperature of the engine is higher than a predetermined value;

(2) setting a rate at which the correction value is to vary, such that the set fuel quantity decreases at a first rate with a rise in the rotational speed of the engine, when it is determined that the temperature of the engine is higher than the predetermined value;

(3) setting the rate at which the correction value is to vary, such that the set fuel quantity decreases at a second rate smaller than the first rate with a rise in the rotational speed of the engine, when it is determined that the temperature of the engine is lower than the predetermined value; and (4) correcting the set fuel quantity by means of the correction value having the varying rate thereof set in step (2) or step (3), while the engine is in the predetermined starting condition.

The above and other objects, features, and advantages of the invention will be more apparent from the ensuing detailed description taken in conjunction with the accompanying drawings.

DETAILED DESCRIPTION

The method of the invention will now be described in detail with reference to the drawings showing an embodiment thereof.

Figure 1:
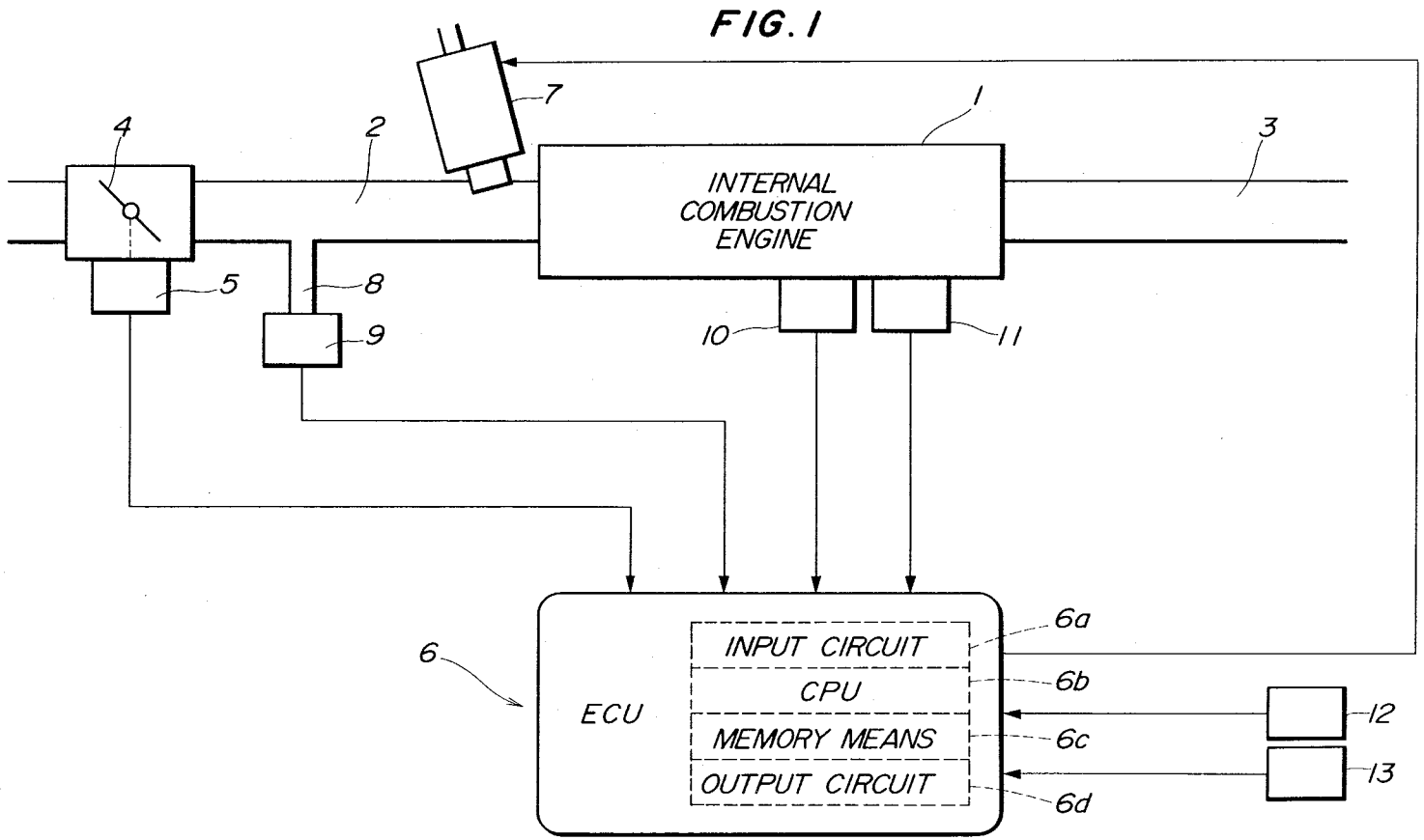
FIG. 1 is a block diagram of the whole arrangement of a fuel supply control system for an internal combustion engine, to which is applied the method according to the present invention.

Referring first to FIG. 1, there is illustrated the whole arrangement of a fuel supply control system for an internal combustion engine to which is applied the method of the invention. In the figure, reference numeral 1 designates an internal combustion engine which may be a four-cylinder type, for instance. An intake pipe 2 and an exhaust pipe 3 are connected, respectively, to an intake side and an exhaust side of the cylinder block of the engine. A throttle valve 4 is arranged within the intake pipe 2, to which is connected a throttle valve opening (oth) sensor 5, which detects the throttle valve opening oth by converting same into an electric signal and supplies the electric signal to an electronic control unit (hereinafter called "the ECU") 6.

Fuel injection valves 7 are arranged in the intake pipe 2 at locations between the engine 1 and the throttle valve 4, slightly upstream of respective intake valves, not shown, of respective cylinders. Each of the fuel injection valves are connected to a fuel pump, not shown, and also electrically connected to the ECU 6 to have it valve opening period controlled by a valve-opening driving signal from the ECU 6.

On the other hand, an absolute pressure (PBA) sensor 8 is connected to the intake pipe 2 via a pipe 8 at a location immediately downstream of the throttle valve 4, which detects the absolute pressure PBA by converting same into an electric signal and supplies the electric signal to the ECU 6.

Mounted on the cylinder block of the engine 1 is an engine coolant temperature (TW) sensor 10 which is embedded in a peripheral wall of a cylinder filled with coolant and senses the engine coolant temperature TW as a temperature representative of the engine temperature and supplies an electrically converted signal to the ECU 6.

An engine rotational speed (Ne) sensor 11 is arranged in facing relation to a camshaft of the engine or a crankshaft of same, neither of which is shown. The sensor 11 is adapted to generate a pulse of a crank angle position signal as a top-dead-center (TDC) signal at one of predetermined crank angles each in advance of the top dead center position at the start of suction stroke of each cylinder each time the crankshaft of the engine rotates through 180 degrees, and delivers the TDC signal to the ECU 6.

Further connected to the ECU 6 are a starter switch 12, as well as other engine operating parameter sensors 13 such as an atmospheric pressure sensor, which supply signals indicatives of operation of a starting motor, not shown, and the detected operating parameter values, to the ECU 6.

The ECU 6 comprises an input circuit **6*a* which has functions of shaping the waveforms of input signals from the above-mentioned various sensors, shifting the voltage levels of these signals into a predetermined level, converting analog signals from some of the sensors into corresponding digital signals, a central processing unit (hereinafter called "the CPU") 6*b*, memory means 6*c* which stores various control and calculation programs executed within the CPU 6*b*, results of calculations executed by the CPU 6*b*, as well as a TiCR-TW table and a KNe-Ne table, hereinafter described, and an output circuit 6*d* which delivers driving signals to the fuel injection valves 7**.

The ECU 6 calculates the valve opening period TOUT for the fuel injection valves 7 to be applied at the start of the engine, based upon the input signals from the various engine operating parameter sensors and in synchronism with inputting of the TDC signal thereto, by the use of the following equation (1):

$$\mathrm{TOUT} = TiCR \times KNe \times K1 + K2 \qquad (1)$$

where TiCR is a basic value of the valve opening period for the fuel injection valves to be applied at the start of the engine, which is determined by means of the TiCR-TW table in dependence on the engine coolant temperature TW. KNe is an engine rotational speed-dependent correction coefficient according to the invention, which is determined in response to the engine rotational speed Ne. K1 and K2 are correction coefficients and correction variables, respectively, which are calculated based upon output signals indicative of sensed engine operating parameters from various sensors, as well as the output voltage of a battery, not shown, provided for the engine.

The ECU 6 further operates to supply the fuel injection valves 7 with driving signals corresponding to the valve opening period TOUT determined as above, at the start of the engine, and also those corresponding to a valve opening period TOUT for basic control during normal operation of the engine following the start of the engine, hereinafter referred to.

Figure 3:
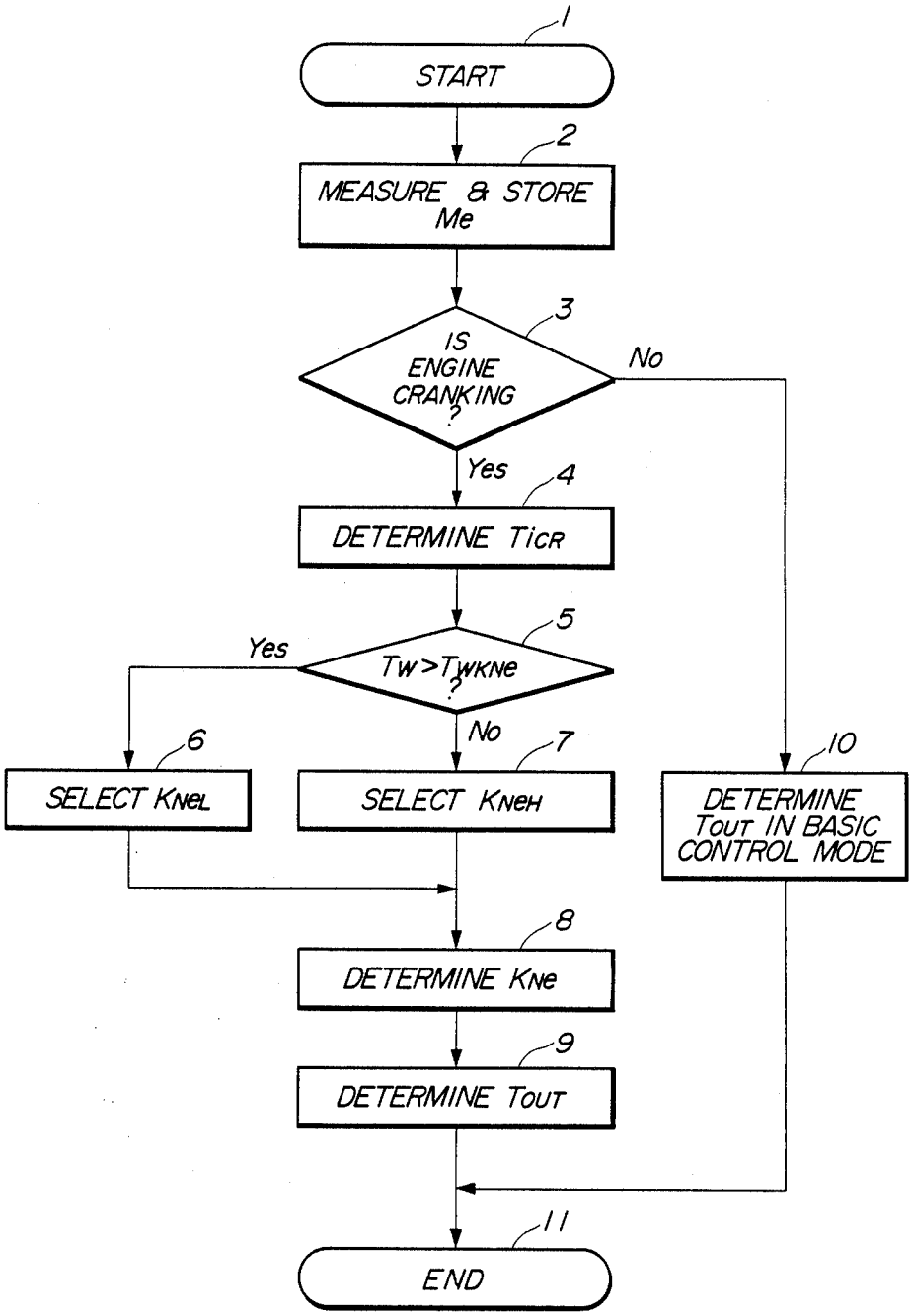
FIG. 3 is a flowchart of a program for calculating the valve opening period of fuel injection valves, executed in a central processing unit (CPU) appearing in FIG. 1.

FIG. 3 illustrates a flowchart of a program for calculating the valve opening period TOUT of the fuel injection valves 7, to be executed within the CPU **6*b* of the ECU 6 in FIG. 1** each time a pulse of the TDC signal is generated.

First, when the starter switch 12 in FIG. 1 is turned on to actuate the starting motor for starting the engine 1, the TDC signal from the Ne sensor 11 is inputted to the CPU **6*b* to initiate execution of the program in synchronism with the inputting of the TDC signal, at step 1. Then, the CPU 6*b* counts the interval of time Me between inputting of an immediately preceding pulse of the TDC signal and inputting of a present pulse of same, which is proportional to the reciprocal of the engine rpm Ne, and stores the counted value into the memory means 6*c* in the ECU 6, at step 2. It is determined at step 3 whether or not the engine is in a starting condition, i.e., in a cranking condition, by determining whether or not the starter switch 12** is on as well as whether or not the engine rotational speed Ne is lower than predetermined cranking rpm (about 400 rpm).

When the step 3 provides an affirmative answer that the engine is in the starting condition, the program proceeds to steps 4 through 9 to determine the valve opening period TOUT for the fuel injection valves 7 in starting control mode, and on the other hand, if the step 3 provides a negative answer, the program proceeds to step 10 to determine the valve opening period TOUT in basic control mode. The valve opening period TOUT to be applied during basic control following the starting control according to the invention may be calculated in a conventional manner, e.g., based upon engine rotational speed Ne and intake pipe absolute pressure PBA or like parameters, description of which is omitted.

Figure 2:
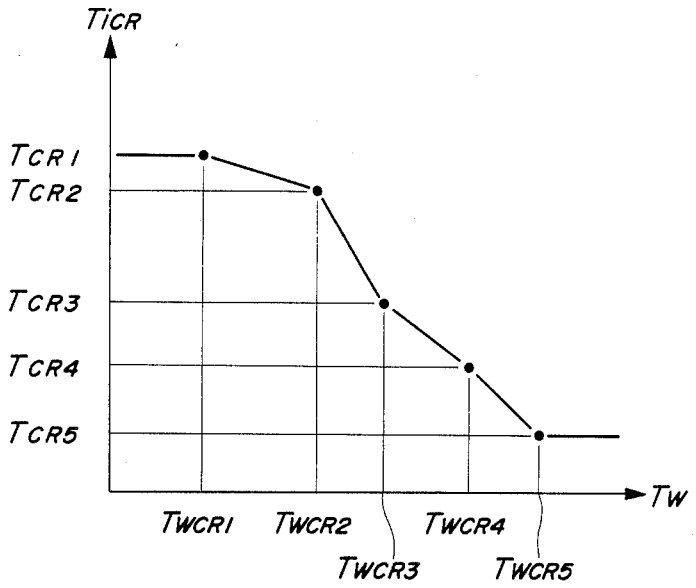
FIG. 2 is a graph showing a table of the relationship between basic valve opening period TiCR of fuel injection valves applied at the start of the engine and engine coolant temperature Tw.

When the engine is in the starting condition, the answer to the question of step 3 will be affirmative, and the program then proceeds to step 4 wherein a basic value TiCR of the valve opening period is read from the TiCr-TW table stored in the memory means 6c, that corresponds to the detected engine coolant temperature TW. FIG. 2 shows an example of the TiCR-TW table, wherein five predetermined values TCR1-5 of the basic valve opening period TiCR and five predetermined values TWCR1-5 of the engine coolant temperature TW are provided as calibration variables dependent upon the engine coolant temperature TW. If the detected engine coolant temperature TW value falls between adjacent ones of the predetermined values TWCR1-5, the basic valve opening period value TiCR is calculated by an interpolation method.

At the next step 5, a determination is made as to whether or not the detected engine coolant temperature TW is higher than a predetermined value TWKNE (e.g. 10° C.) to discriminate whether the engine is in a warmed-up condition or in a cold condition. The predetermined value TWKNE corresponds to a value of intake pipe temperature which has been obtained experimentally and which is critical such that the fuel evaporation characteristic at the start of the engine is largely different between when the engine coolant temperature TW is above the predetermined value TWKNE and when the former is below the latter. Depending upon whether the engine coolant temperature TW is higher or lower than the predetermined value TWKNE, it is decided whether to set the decrease rate of the fuel supply quantity responsive to an increase in the engine rotational speed to a higher value or to a lower value. To be specific, when the answer to the question of the step 5 is affirmative or yes, a correction coefficient KNeL is selected as the correction coefficient KNe, at step 6, while if the answer is negative or no, another correction coefficient KNeH is selected, at step 7.

Figure 4:
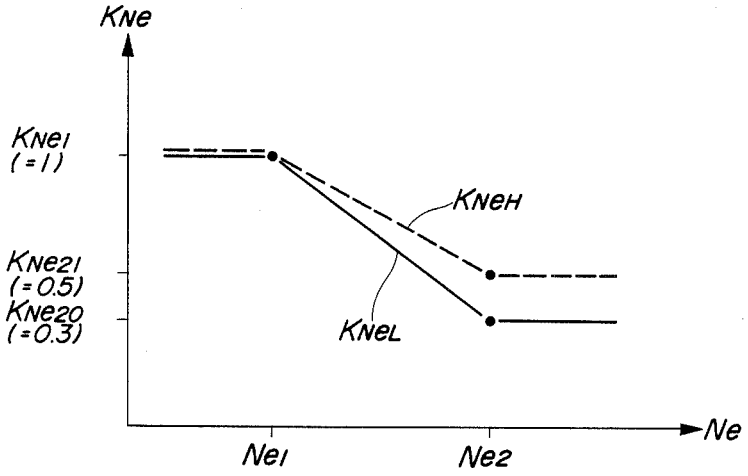
FIG. 4 is a graph showing a table of the relationship between an engine rotational speed-dependent correction coefficient KNe applied at the start of the engine and engine rotational speed Ne.

FIG. 4 shows a graph of an example of the KNe-NE table. According to the graph, the correction coefficient KNeL, which is selected when the engine is in a warmed-up condition as noted above, is set such that it is kept at a constant value (=1.0) below a lower predetermined rpm value Nel (e.g., 100 rpm), it is decreased at a relatively large rate as the engine rotational speed Ne rises from the predetermined lower value Ne1 to a predetermined higher value Ne2 (e.g., 400 rpm) as indicated by the solid line in FIG. 4, and it is kept at a constant value KNe20 (e.g., 0.3) as the engine rotational speed Ne further rises above the predetermined higher value Ne2. On the other hand, the correction coefficient KNeH, which is selected when the engine is in a cold condition, is set such that it is kept at the same constant KNe1 as applied to the correction coefficient KNeL when the engine rotational speed Ne is below the predetermined lower value Ne1, it is decreased at a rate smaller than the decrease rate of the correction coefficient KNeL as the engine rotational speed Ne rises from the predetermined lower value Ne1 to the predetermined higher value Ne2, as indicated by the broken line in FIG. 4, and it is kept at a constant value KNe21 (=0.5) which is larger than the constant value KNe20 applied to the correction coefficient KNeL.

Referring again to FIG. 3, step 8 reads values of the correction coefficient KNeL or KNeH selected at the steps 6 and 7, that correspond to the engine rotational speed Ne, and adapts the read values of correction value KNeL or KNeH as the correction coefficient KNe.

In the next step 9 the basic valve opening period value TiCR determined at the step 4 and the correction coefficient KNe determined at the step 8 are substituted into the aforegiven equation (1) to calculate the valve opening period TOUT for the fuel injection valves 7, followed by termination of the program at step 11.

As set forth above, according to the invention, the rate at which the correction coefficient KNe decreases with a rise in the engine rotational speed Ne is set to different values, depending upon whether the engine coolant temperature TW is higher or lower than the predetermined value TWKNE. This makes it possible to effect the fuel supply to the engine in a manner commensurate with the engine temperature at the start of the engine to thereby enhance the startability of the engine in a cold state.

Although in the foregoing embodiment the engine rotational speed-dependent correction coefficient KNe has been employed for correcting through multiplication the basic valve opening period TiCR in dependence on the engine temperature, a correction variable TNe may alternatively be employed for correcting through addition the same basic valve opening period, by the use of the following equation (2), for instance:

$$TOUT=(TiCR+TNe)\times K1+K2 \quad (2)$$

What is claimed is:

1. In a method of controlling fuel supply to an internal combustion engine at the start thereof, wherein an initial value of a fuel quantity to be supplied to said engine is set in dependence on a temperature of said engine when said engine is in a predetermined starting condition, and said intial value of the fuel quantity thus set is corrected to an increased value by means of a correction value which varies with a rise in the rotational speed of said engine, said increased value being deceased with a rise in the rotational speed of said engine by said correction value, the improvement comprising the steps of:

(1) determining whether or not the temperature of said engine is higher than a predetermined value;

(2) setting a rate at which said correction value is to vary, such that the set fuel quantity decreases from said increased value thereof at first rate with a rise in the rotational speed of said engine, when it is determined that the temperature of said engine is higher than said predetermined value;

(3) setting the rate at which said correction value is to vary, such that the set fuel quantity decreases from said increased value thereof at a second rate smaller than said first rate with a rise in the rotational speed of said engine, when it is determined that the temperature of said engine is lower than said predetermined value; and (4) correcting the set fuel quantity by means of said correction value having the varying rate thereof set in step (2) or step (3), while said engine is in said predetermined starting condition.

2. A method of controlling fuel supply to an internal combustion engine at the start thereof, wherein a fuel quantity to be supplied to said engine is set in dependence on a temperature of said engine when said engine is in a predetermined starting condition, and the fuel quantity thus set is corrected to an increased value by being multiplied by a correction value which decreases with a rise in the rotational speed of said engine, said method comprising the steps of:

(1) determining whether or not the temperature of said engine is higher than a predetermined value;

(2) providing as said correction coefficient a first correctiom coefficient which decreases at a first rate with a rise in the rotational speed of said engine, and a second correction coefficient which decreases at a second rate smaller than said first rate with a rise in the rotational speed of said engine;

(3) selecting said first said correction coefficient, when it is determined that the temperature of said engine is higher than said predetermined value;

(4) selecting said second correction coefficient, when it is determined that the temperature of said engine is lower than said predetermined value; and (5) correcting the set fuel quantity by means of the correction coefficient selected in step (3) or step (4), while said engine is in said predetermined starting condition.

3. A method as claimed in claim 1, wherein the temperature of said engine is the temperature of engine coolant.

4. A method as claimed in claim 1, wherein said predetermined starting condition of said engine is a condition in which the rotational speed of said engine is lower than predetermined rpm.

5. A method as claimed in claim 4, wherein said correction value varies such that the set fuel quantity decreases as the rotational speed of said engine rises from a first predetermined value lower than said predetermined rpm to a second predetermined value higher than said first predetermined value but lower than said predetermined rpm.

6. A method as claimed in claim 1, wherein said correction value is a correction coefficient for correcting the set fuel quantity through multiplication.

* * * * *